United States Patent [19]

Hurner

[11] Patent Number: 4,475,498

[45] Date of Patent: Oct. 9, 1984

[54] ENGINE DETECTING DEVICE

[76] Inventor: Erwin E. Hurner, 2605 S. Rivershore, Moorhead, Minn. 56560

[21] Appl. No.: 561,839

[22] Filed: Dec. 15, 1983

[51] Int. Cl.[3] ..... F02B 77/08

[52] U.S. Cl. ..... 123/198 DB; 123/41.15; 123/196 S; 123/198 D

[58] Field of Search ..... 123/41.15, 196 S, 198 D, 123/198 DB, 198 DC

[56] References Cited

U.S. PATENT DOCUMENTS

| | | | |
|---|---|---|---|
| 2,123,460 | 7/1938 | Burschkies | 123/196 S |
| 2,123,461 | 7/1938 | Burschkies | 123/196 S |
| 2,618,248 | 11/1952 | Lindberg, Jr. et al. | 123/41.15 |
| 3,533,391 | 10/1970 | Lockmuller | 123/41.15 |
| 3,694,804 | 9/1972 | Hill | 123/41.15 |
| 3,832,982 | 9/1974 | Guehi | 123/41.15 |
| 4,034,732 | 7/1977 | Van Burkleo | 123/198 DC |
| 4,147,151 | 4/1979 | Wright | 123/198 DC |

*Primary Examiner*—Ira S. Lazarus

*Attorney, Agent, or Firm*—Bailey & Hardaway

[57] ABSTRACT

A detection device having pushbutton operation which after a short predetermined period of time indicates by means of lights whether both oil and lubricant levels are adequate or if not which is not satisfactory. The device is coupled with circuitry so as to quickly activate a thermistor within the lubricant reservoir for accurate detection at that point and may be coupled with engine deactivation means to preclude engine operation in the event that the device is not activated or in the event that either of the coolant or lubricant levels are inadequate.

7 Claims, 2 Drawing Figures

ENGINE DETECTING DEVICE

BACKGROUND OF THE INVENTION

This invention relates generally to the art of internal combustion driven vehicles and more particularly to a device for detecting lubricant and coolant levels within the engines of such vehicles.

The ultimate lifetime maintenance and extraordinary maintenance expenses associated with vehicles driven by internal combustion engines is to a large extent determined by the maintenance of appropriate coolant and lubricant levels within the engines of such vehicles. These costs can be particularly exaggerated in diesel driven trucks, and in fleet operation such costs are multiplied by the number of trucks in the fleet. As is well known the life of a diesel engine is to a large extent determined and even extended by appropriate maintenancing; particularly the maintenance of oil lubricant and water coolant levels during operation.

While owner operators of diesel trucks have a large financial incentive in maintaining appropriate lubricant and coolant levels within the vehicle during operation, such incentives do not always exist with the hired driver. Even owner operators, however, frequently overlook maintenance of appropriate coolant and lubricant levels in the mistaken haste of maintaining delivery schedules. All such neglect is to the detriment of the life expectancy of the diesel engine.

SUMMARY OF THE INVENTION

It is thus an object of this invention to provide a device for detecting appropriate lubricant and coolant levels within an internal combustion engine vehicle.

It is a further object of this invention to provide such a device to quickly and reliably detect whether appropriate lubricant and coolant levels are in existence without the need for checking under the hood of such vehicle.

It is a still further and more particular object of this invention to provide such a device which may be coupled with engine operation to preclude engine operation upon the occurrence of certain events.

It is a still further and more particular object of this invention to provide such a device which encourages operator use thereof.

These as well as other objects are accomplished by a detection device having push button operation which after a short predetermined period of time indicates whether both coolant and lubricant levels are adequate or if not which is not satisfactory. Such device has circuitry to quickly activate a thermistor within the lubricant reservoir for accurate detection at that point and may be coupled with engine deactivation means to preclude engine operation in the event that the device is not activated or in the event that either of the coolant or lubricant levels are inadequate.

DETAILED DESCRIPTION

In accordance with this invention it has been found that a very simple device may be incorporated into the cab of a diesel driven truck or other motor vehicle which provides a simple thumb depression switch which after a predetermined period of time will indicate whether coolant and oil levels are satisfactory and if not which if not both are unsatisfactory. The device incorporates very simple circuitry to overcome a significant problem associated with the use of a thermistor to detect oil level.

Drivers frequently neglect the task of checking lubricant and coolant levels in view of the difficulty thereof. With the device in accordance with this invention the task is made simple and as will be further described can be made mandatory. Various other advantages and features will become apparent upon the reading of the following description with reference to the various figures of drawing.

Figure 1:
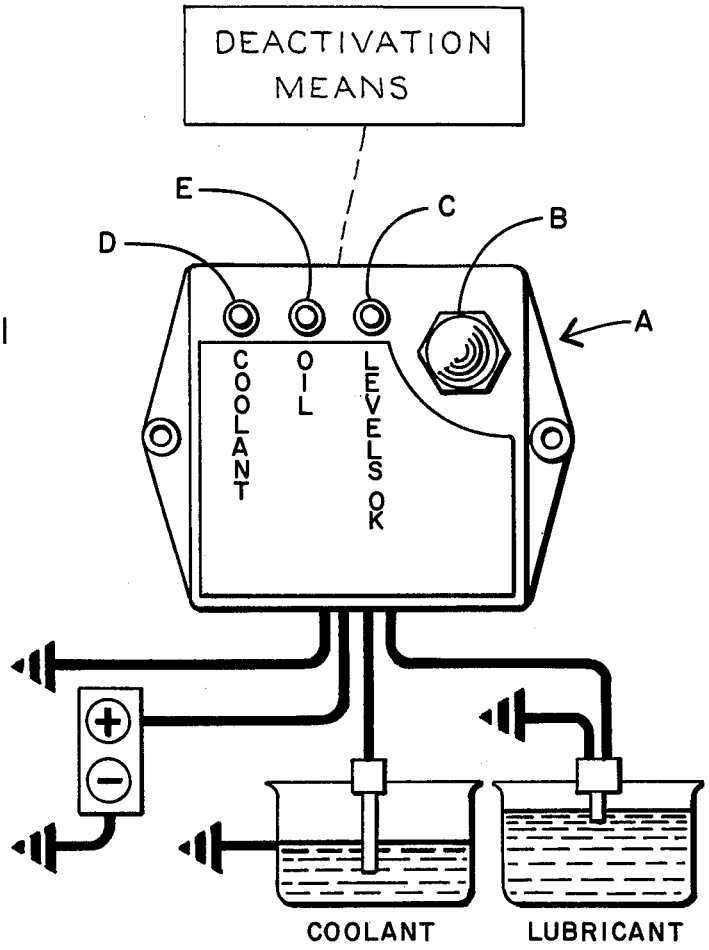
FIG. 1 of the drawings schematically illustrates the detection device in accordance with this invention.

FIG. 1 of the drawings illustrates schematically the device A in accordance with this invention. The device A comprises a thumb depression switch B, a light emitting diode C indicating appropriate levels of lubricant and coolant, as well as light emitting diodes D and E which in the event of failure of light emitting diode C to activate will indicate which or both of the appropriate fluids are inadequate. The device A is in communication with a battery and with coolant and lubricant reserviors as indicated in FIG. 1. Device A incorporates circuitry which will be further described with reference to FIG. 2 of the drawings.

Figure 2:
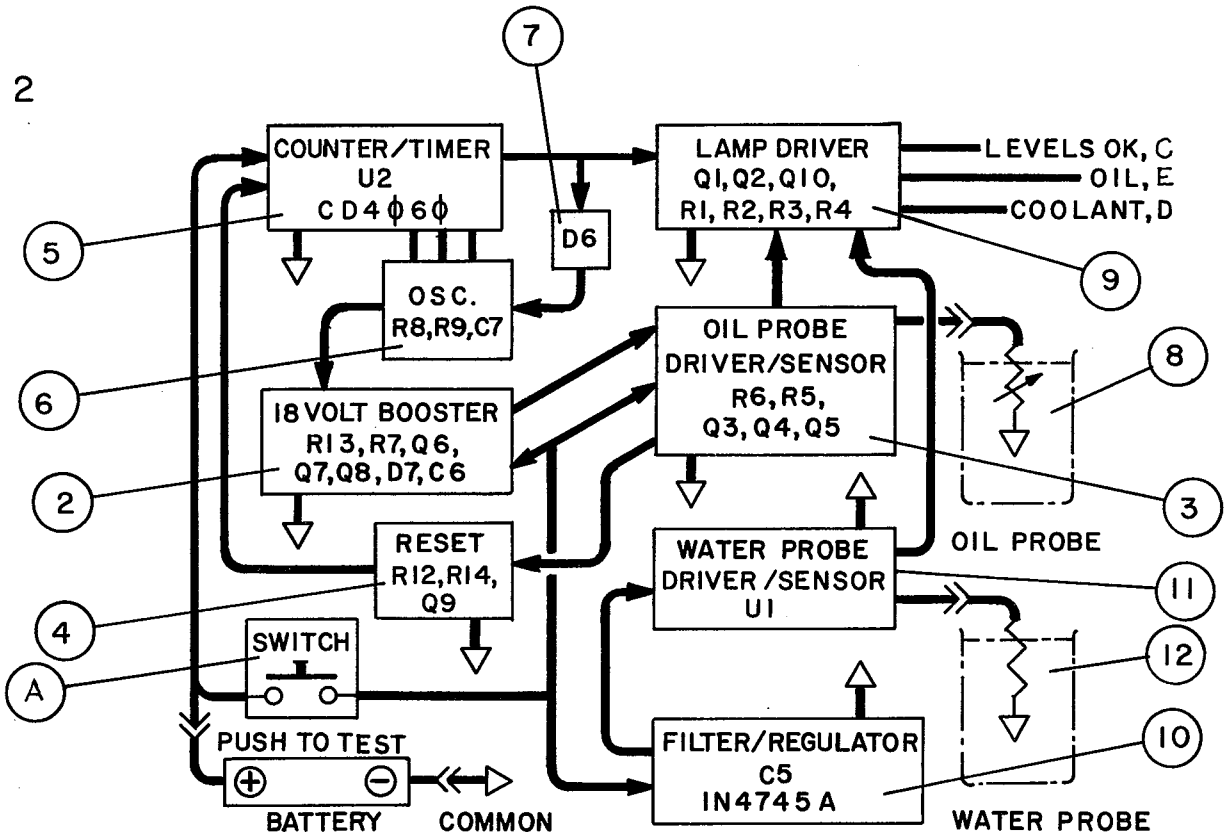
FIG. 2 of the drawings illustrates the circuitry associated with the device in accordance with this invention.

FIG. 2 illustrates a block diagram of the circuitry of the detection device of this invention. When the switch A is depressed, power is applied to the 18 volt booster 2. Power is simultaneous applied to the Oil Probe Driver/Sensor 3, which in turn supplies power to the reset circuit 4. This causes a voltage to be applied across R12 and R14 to cause Q9 to turn on thus removing the reset from the Counter Timer circuit 5.

The counter U2 is preferrable a CD4060 integrated circuit. R8, R9 and C7 form an Oscillator circuit 6 with the input pins on timer circuit 5.

The oscillator 6 clocks the counter until it times approximately four seconds. During this time the clock pulses are also applied to the booster 2 through R13 and the booster created 18 volt pulses into the Oil probe driver 3. These pulses are applied to the Oil probe thermistor 8 which significantly decreases the heating and response time of the probe itself.

At the time, power was applied by activation of the switch 1 power was also applied through the Filter/-Regulator 10 which comprises C5 into the Water Probe Sensor which is preferrably an LM1830 integrated circuit. C1, C2, C3 and C4 enable sensor 11 to detect the presence of coolant at a sufficient level to contact the water probe 12. If the coolant contacts the probe then the sensor 11 will signal the lamp drivers 9 not to turn on the coolant lamp D.

When the counter 5 has timed out D6 6 halts the oscillator 6 by a signal from U2, 5 which also activates the lamp drivers 9. The 18 volt booster pulses also stops and if both the lubricant probe 8 and the coolant probe 12 are contacting their fluids then coolant lamp D and the oil lamp E will both be off and the levels OK lamp C will be on. If neither probe or both probes are not making contact the respective lamp will light and Q1 will sense this and turn lamp C off.

The above circuitry provides a unique arrangement for activation of a thermistor lubricant probe in less than five (5) seconds. Without such circuitry detection would require thirty (30) to fourty-five (45) seconds and would require an operator to maintain pressure switch B to press for that entire period of time. The above device thus permits maintenance detection within five (5) seconds or less.

As an alternative feature of this invention the circuitry above described may be coupled with circuitry to deactivate the engine in the event that light emitted diode C is not activated or in the event that the operator does not initiate activity of the device A by depressing switch B. The engine deactivation device comprises a valve in the fuel supply line as is described in U.S. Pat. No. 4,294,204 of common inventorship herewith and which is hereby incorporated by reference. Such device is schematically illustrated in FIG. 1 by connection to engine deactivation means.

It is thus seen that the device in accordance with this invention provides simple circuitry for detecting appropriate coolant and lubricant levels within an internal combustion engine vehicle. Such device is simple easy to operate from the driver compartment and may provide for engine deactivation upon the occurance of undesirable events. As many variation will become apparent to those of skill in the art from a reading of the above specification, such variations are within the scope of this invention as is defined by the following appended claims.

That which is claimed is:

1. A detection device for sensing lubricant and coolant levels in a motor driven vehicle, comprising a lubricant level probe comprising a thermistor;

a coolant level probe;

circuitry communicating with said probes having a booster and timer to boost a normal D.C. power source of 12 volts to pulses of 18 volts across said thermistor for predetermined period of times set by said timer;

a normally off pressure switch activating said circuitry;

a first light emitting diode communicating with said circuitry to light at the end of said predetermined period of time if both of said probes detect the pressence of the appropriate fluid; and a second and third light emitting diodes associated with said coolant and lubricant level probes respectively and said circuitry to light in the absence of appropriate fluid instead of said first light emitting diode.

2. The device in accordance with claim 1 wherein said predetermined period of time is five (5) seconds or less.

3. The device in accordance with claim 1 wherein said coolant probe completes a circuit through said coolant in the presence of an appropriate coolant level but presents an open circuit to said circuitry in the absence of an appropriate coolant level.

4. The device in accordance with claim 1 wherein said pressure switch must be manually engaged for said predetermined period of time for any of said light emitting diodes to be activated.

5. The device in accordance with claim 1 including engine deactivation means associated with said circuitry to prevent engine activation in the event said first light emitting is activated.

6. The device in accordance with claim 1 including engine deactivation means in the event said pressure switch is not depressed for said predetermined period of time.

7. The device according to claim 1 wherein said thermistor heats in the absence of lubricant to lower its resistance and establish electrical communication with ground, but is called in the presence of lubricant to maintain an open circuit to ground.

* * * * *